US008118639B1

(12) United States Patent
Boon

(10) Patent No.: US 8,118,639 B1
(45) Date of Patent: Feb. 21, 2012

(54) NIPPLE CONCEALMENT DEVICE AND METHOD

(76) Inventor: Angela Boon, Bartlesville, OK (US)

( * ) Notice: Subject to any disclaimer, the term of this patent is extended or adjusted under 35 U.S.C. 154(b) by 242 days.

(21) Appl. No.: 12/381,543

(22) Filed: Mar. 13, 2009

Related U.S. Application Data

(60) Provisional application No. 61/038,321, filed on Mar. 20, 2008.

(51) Int. Cl.
*A41C 3/00* (2006.01)

(52) U.S. Cl. ..... 450/37; 450/39; 450/54

(58) Field of Classification Search ..... 450/36–39, 450/54–58; 2/267, 268; 623/7, 8
See application file for complete search history.

(56) References Cited

U.S. PATENT DOCUMENTS

| | | | | |
|---|---|---|---|---|
| 2,345,649 | A * | 4/1944 | Zimmerman et al. | 450/57 |
| 3,190,292 | A * | 6/1965 | Barnes | 450/55 |
| 3,196,464 | A * | 7/1965 | McKee | 623/7 |
| 5,782,672 | A | 7/1998 | Woodley | 450/57 |
| 6,083,080 | A * | 7/2000 | Lawson et al. | 450/39 |
| 6,338,665 | B1 * | 1/2002 | Dawson et al. | 450/57 |
| 6,350,175 | B2 | 2/2002 | Johnson et al. | 450/81 |
| 6,419,548 | B1 * | 7/2002 | Wittes et al. | 450/57 |
| 6,881,123 | B1 * | 4/2005 | Klakauskas | 450/39 |

* cited by examiner

*Primary Examiner* — Gloria Hale
(74) *Attorney, Agent, or Firm* — Phillips Murrah PC; Martin G. Ozinga

(57) ABSTRACT

An apparatus for concealing a bodily protrusion such as a human nipple comprising a foam pad for placing against the protrusion and a rubber pad for placing against a garment interior like the inside of a brassiere cup wherein the foam pad and the rubber pad are attached together.

2 Claims, 2 Drawing Sheets

NIPPLE CONCEALMENT DEVICE AND METHOD

CROSS-REFERENCE TO RELATED APPLICATIONS

Priority is claimed from provisional patent application U.S. Ser. No. 61/038,321 filed on Mar. 20, 2008 and incorporated by reference herein.

BACKGROUND OF THE INVENTION

1. Field of the Invention

In general, this invention relates to a device, system and method for concealing a bodily protrusion. More particularly, the present invention relates to an article of apparel and method for obfuscating, hiding or concealing an erect nipple through the clothing covering the breast.

2. Description of the Known Prior Art

Throughout recorded history, women have used a variety of garments and devices to cover, restrain, or elevate their breasts. Women tend to rely on their brassier to support and enhance their breasts during everyday activities. Today, however, many modern woman desire to have a brassier, or bra, that not only provides functionality, but also flatters their natural beauty in a way that is tasteful, yet not excessively provocative.

An often embarrassing problem exists, one in which a variety of apparatus and methods have attempted to address, that certain women experience when they wish to wear clothing that is flattering, but may otherwise allow a protrusion, profile image, or "tenting" of the garment over the nipple. Not only is this tenting effect considered highly personal for a woman, but may also portray an undesired image of a woman in such circumstances like the workplace, professional and business meeting and in many social settings.

For years now, women have fought to overcome gender discrimination in all facets of life, and especially in the workplace and higher education. Recognizing that significant efforts have been made to eradicate gender discrimination, a struggle still stands to ensure that women are placed on an equal footing with men. The last thing that a talented female attorney or articulate businesswoman needs is to not be taken seriously simply because the temperature is cold, or perhaps a simple brush of the skin, has caused this tenting effect.

Numerous U.S. design patents and U.S. utility patents describe devices and apparel for women that are intended to provide women with more modesty protection by either covering the entire breast, or only covering the nipple and areola of a woman's breast. For example, U.S. Pat. No. 5,782,672 issued to Woodley on Jul. 21, 1998, discloses a nipple pad made of a pliable elastic material, such as latex or other polymeric material, with an adhesive strip affixed to the material for covering the nipple of a female breast. Likewise, U.S. Pat. No. 6,350,175 issued to Johnson, et al. on Feb. 26, 2002, discloses a method and device for concealing an erect nipple wherein an adhesive is coated over a major portion of one side of the device in order to adhere directly to the nipple.

Although such devices can provide modesty coverage for the wearer, the requirement that wearers use relatively large areas of adhesive to attach the devices can be quite uncomfortable. Special precautions are recommended by the manufacturers, such as using a special skin-preparation lotion before applying the adhesive coverings, wearing them for a very limited amount of time before removing them, and taking special precautions to remove the coverings carefully and by pre-lubrication with baby oil, for example, so as not to provide excessive damage to the skin. Nonetheless, the skin can be irritated and made to become very sore by the use of such devices.

Another disadvantage of such adhesive covers is that they can be used only once and then must be thrown away. This adds expense and waste.

Padded concealment "solutions" include padded or foam devices that surround the nipple or protrusion at a distance away from the skin such that the nipple has enough room to erect into the pad. A common drawback of these padded solutions is the creation of an unnatural curve around the breast. Furthermore, a tenting effect can still occur in pads that have lost their thickness due to repeated washing and wearing.

Several U.S. design patents and U.S. utility patents also disclose various articles of apparel that cover the entire breast. For example, U.S. Pat. No. 6,419,548 issued to Wittes et al. on Jul. 16, 2002, discloses a concave shield member made of soft, flexible material. In use, the soft, flexible material is in direct contact with the skin of the wearer. Such direct contact is known to cause irritation and/or perspiration. Furthermore, the soft, flexible material may also slip from the nipple and areola portion of the breast, thereby negating its purpose.

It is therefore desirable to provide a device, system and method for concealing a bodily protrusion in which the foregoing disadvantages are alleviated or eliminated. The above discussed limitations in the prior art is not exhaustive. The current invention provides an inexpensive, less irritating, more reliable and less wasteful apparatus, system and method where the prior art fails or is deficient. Other noteworthy problems may also exist; however, those mentioned here are sufficient to demonstrate that methodology appearing in the art has not been altogether satisfactory and that a significant need exists for the invention described and claimed here.

BRIEF SUMMARY OF THE INVENTION

In view of the foregoing disadvantages inherent in the known types of apparatus, systems and methods now present in the prior art, the present invention provides a new and improved device, system and method which allows a user to obfuscate, hide or conceal an erect nipple, or protrusion, in a flattering, natural way. As such, the general purpose of the present invention, which will be described subsequently in greater detail, is to provide an article of apparel that alleviates the often embarrassing problem that women experience when a nipple can be seen as protruding into the garment overlying the nipple.

To attain this, the present invention essentially comprises a pad constructed in accordance with the present invention that cooperates with a brassiere to provide a device, system, and method that may be utilized either on a daily basis or periodically to conceal an erect nipple, or protrusion. It is contemplated that the pad of the present invention may comprise a variety of materials arranged in separate layers.

For the sake of brevity, the present invention is generally described herein as relating primarily to nipple concealment; however, it should be understood that the current invention is not limited to just nipples, and has application to any type of skin protrusion, like raised moles, warts, and growths. In a similar manner, it is understood that the present invention may be useful for men, as well as women, and should not be regarded as limited to only one specific gender. Furthermore, it should be understood that the present invention may be used in conjunction with a specific brassiere designed to accommodate the present invention, with a conventional brassiere well known in the art, or independent of a brassiere. It is contemplated the current invention may be built into a brassiere, slipped into a conventional brassiere, slipped into a modified brassiere having a receptor portion for an insert, and combinations thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other devices, methods, and systems for carrying out the several purposes of the present invention. It is important, therefore, that the claims be regarded as including such equivalent constructions insofar as they do not depart from the spirit and scope of the present invention.

Further, the purpose of the foregoing Background and Brief Summary of the Invention is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. As such, the Background and Brief Summary is neither intended to define the invention of the application, which is measured by the claims, nor is it intended to be limiting as to the scope of the invention in any way.

Therefore, it is an object of the present invention to provide a new and improved device, system, and method for concealing an erect nipple, or protrusion.

It is a further object of the present invention to provide a new and improved device, system, and method for concealing an erect nipple, or protrusion, that is susceptible to a low cost of manufacture with regard to both materials and labor, and which accordingly is then susceptible to low prices of sale to the consuming industry, thereby making such device, system, and method economically available to all potential users.

Still another object of the present invention is to provide a new and improved device, system, and method for concealing an erect nipple, or protrusion, that provides all of the advantages of the prior art, while simultaneously overcoming the disadvantages normally associated therewith.

Another object of the present invention is to provide a new and improved device, system, and method for concealing an erect nipple, or protrusion, that may be easily and efficiently manufactured and marketed.

Yet another object of the present invention is to provide a new and improved device, system, and method for concealing an erect nipple, or protrusion, that provides a less irritating and painful method of concealment than the prior art.

An even further object of the present invention is to provide a new and improved device, system, and method for concealing an erect nipple, or protrusion, that is of a durable and reliable construction and may be used time and time again.

Still another object of the present invention is to provide a new and improved device, system, and method for concealing an erect nipple, or protrusion, that is comfortable to the wearer, and provides a natural, flattering look.

Yet another object of the present invention is to provide a new and improved device, system, and method for concealing an erect nipple, or protrusion, that may be adapted for use with a specially designed brassiere, a conventional brassiere, or independently worn.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE SEVERAL VIEWS OF THE DRAWING

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF THE INVENTION

Figure 1:
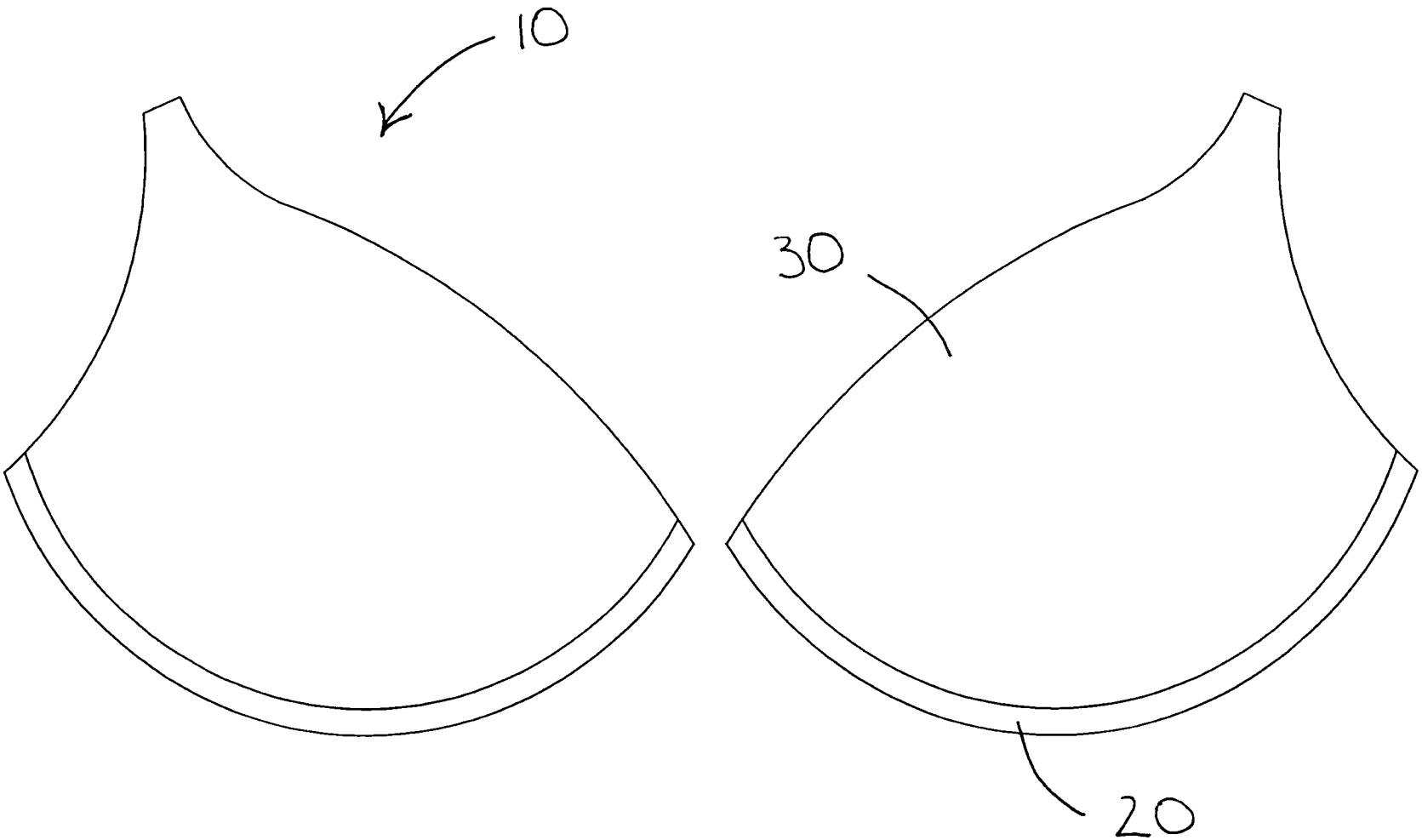
FIG. 1 portrays a front view of a nipple concealment device constructed in accordance with the present invention.

Referring now to the drawings, illustrations, pictures and attachments, and more particularly to FIG. 1, reference numeral 10 designates a device, system and method, which allows a user to obfuscate, hide or conceal an erect nipple, or protrusion, in a flattering, natural way, constructed in accordance with the present invention.

In a preferred embodiment, the invention 10 may be constructed in a manner that essentially provides two materials for concealment purposes: a foam pad 20 and a soft rubber pad 30. The foam pad 20 and the soft rubber pad 30 are shown to be shaped in a substantially similar manner such that the foam pad 20 and the soft rubber pad 30 can be in direct contact with one another. The soft rubber pad 30 is shown to be on top of the foam pad 20 such that the foam pad 20 is in direct contact with the skin of the wearer. It is understood that the word "pad" should not be consider to limit the invention as such.

It is contemplated that foam pad 20 would generally cushion against the users nipple or other body protrusion and rubber pad would 30 provide a surface against the brassiere interior wherein the rubber or like material would generally provide a slip free or reduced slip contact between invention 10 and the brassiere. It is understood that invention 10 use of the rubber or rubber like material would allow placement such that an adhesive is not required to either stick invention 10 to the brasserie and or invention 10 to the user.

It is understood that brassieres are available in many variations, styles, and types. As such, the foam pad 20 and soft rubber pad 30, either independently or together, may be of different sizes, shapes, styles, and so forth. It is further contemplated that invention 10 may be constructed of a variety of materials to achieve the purpose of concealing an erect nipple, or protrusion. For example, the material for the foam pad 20 may include, but is not limited to, polyurethane, polyethylene, cotton, polyester, polypropylene foam, and the like. Furthermore, it is preferred that the material for the soft rubber pad 30 be relatively soft and semi-rigid. As such, it is contemplated that the material for the soft rubber pad 30 may include, but is not limited to, rubber, foam-rubber, vinyl, silicone rubber, styrene based thermoplastic elastomer, Acrylonitrile Butadiene Styrene, and the like. It is understood that the term "rubber" may also include natural rubber and man made rubber.

It is also contemplated that rubber or other like material may be applied to foam pad 20 in general. The rubber or like material may be sprayed, dipped, brushed, or otherwise applied. It is understood that numerous means of applying the rubber or rubber like material may be utilized and the above discussion should not be considered to limit the invention as such. It is also understood that foam pad 20 may be bonded to rubber pad 30 by known conventional means such as but not limited to an adhesive layer, glue, press fit and so forth.

In a preferred embodiment, the invention 10 may be used in conjunction with a brassiere (not shown) by inserting the invention 10 inside an opening of the brassiere. The invention 10 may then be secured inside the brassiere by any fastening means feasible (sewing, buttons, slide seal, zipper, etc). It is understood that such arrangement may not require the two types of materials explained above to achieve the stated purpose, and may only require the use of the soft rubber pad 30.

Figure 2:
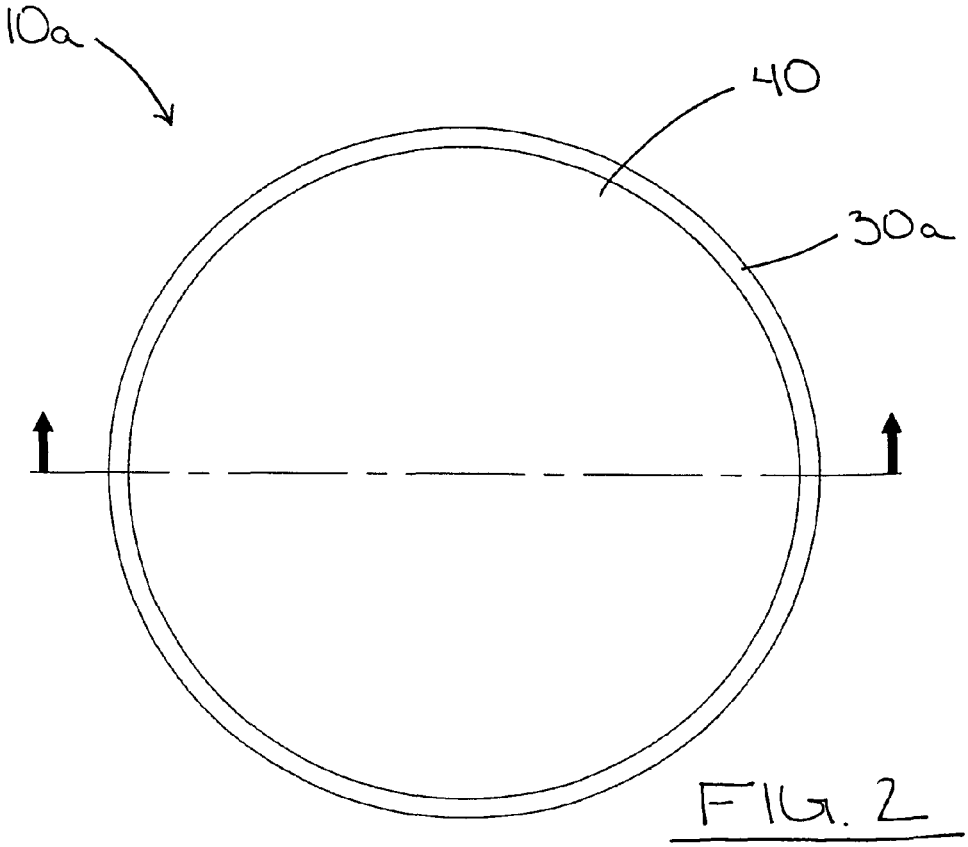
FIG. 2 shows a front view of an alternative embodiment of a nipple concealment device constructed in accordance with the present invention.
Figure 3:
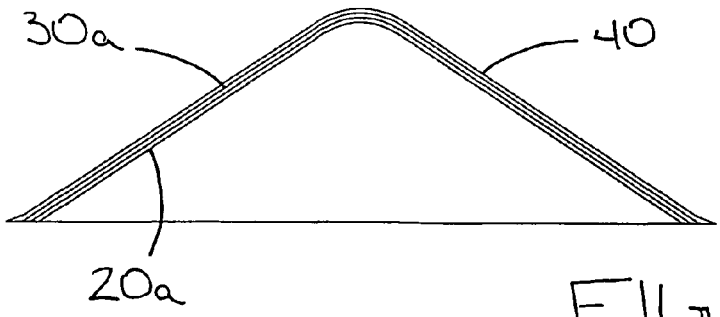
FIG. 3 displays a cross-sectional view of the nipple concealment device shown in FIG. 2.

Referring now to FIGS. 2 and 3, reference numeral 10*a* designates a device, system and method, which allows a user to obfuscate, hide or conceal an erect nipple, or protrusion, in a flattering, natural way, constructed in accordance with the present invention. In another preferred embodiment, the invention 10*a* may be constructed in a manner that essentially provides three materials for concealment purposes: a foam pad 20*a*, a soft rubber pad 30*a*, and a fabric 40. The foam pad 20*a*, the soft rubber pad 30*a*, and the fabric 40 are shown to be shaped in a substantially similar manner such that the foam pad 20*a*, the soft rubber pad 30*a*, and the fabric 40 can be in direct contact with one another. However, it should be understood that the foam pad 20*a* and soft rubber pad 30*a*, either independently or together, may be of different sizes, shapes, styles, and so forth.

In a preferred embodiment, the invention 10*a* may be used in cooperation with a brassiere (not shown) by inserting the invention 10*a* between the skin and the brassiere. Likewise, it is contemplated that the fabric 40 of the invention 10*a* may have an adhesive quality such that the invention 10*a* may be used independently and attach to the overlying garment.

It is further contemplated that the invention may be used in other applications besides pads to conceal nipple protrusion, such as rubber or other non-slip material push-up pads to prevent slippage of the pad. Furthermore, the invention may be generally used as a prosthesis device to enhance size for breast cancer survivors or others in need of cosmetics enhancements. It is contemplated the current invention my be of a construction such that on a ½ inch to 2 inch pad is utilized to prevent slippage and add enhancement. It is understood that the enhancement may be less than a ½ inch or greater than 2 inches.

From the above description, it is clear that the present invention is well adapted to carry out the objects and to attain the advantages mentioned herein. While presently preferred embodiments of the invention have been described for purposes of disclosure, it will be understood that numerous changes may be made which readily suggest themselves to those skilled in the art and which are accomplished within the spirit of the invention disclosed.

I claim:

1. A molded foam and rubber nipple covering pad to conceal a nipple of a wearer for wear with a garment thereover comprising:

a molded foam pad layer having a first surface for placement against a human nipple; and a second opposite surface with a sprayed rubber coating covering said entire second surface wherein said sprayed rubber coating has a slip free adhesive quality for frictionally adhering said second surface of said pad against an interior surface of said garment worn thereover said nipple pad so that said nipple pad does not slip away from said wearer's nipple when worn.

2. The molded foam and rubber nipple covering pad as claimed in claim 1 wherein said garment is a brassiere.

* * * * *